United States Patent [19]

Wahl

[11] Patent Number: 4,758,125

[45] Date of Patent: Jul. 19, 1988

[54] APPARATUS FOR CLOSING BINDING COMBS TO BIND A STACK OF SHEET MATERIAL TOGETHER

[75] Inventor: Karl Wahl, Grabenstetten, Fed. Rep. of Germany

[73] Assignee: Bielomatik Leuze GmbH & Co., Fed. Rep. of Germany

[21] Appl. No.: 57,162

[22] Filed: Jun. 1, 1987

[30] Foreign Application Priority Data

Jun. 11, 1986 [DE] Fed. Rep. of Germany ..... 3619648

[51] Int. Cl.[4] ..... B42B 5/10

[52] U.S. Cl. ..... 412/39

[58] Field of Search ..... 412/39, 40, 33

[56] References Cited

U.S. PATENT DOCUMENTS 4,537,545 8/1985 Kunzmann ..... 412/39 X

FOREIGN PATENT DOCUMENTS 1611018 11/1972 Fed. Rep. of Germany .

2909690 10/1979 Fed. Rep. of Germany ..... 412/39

2325867 12/1979 Fed. Rep. of Germany .

2403154 8/1980 Fed. Rep. of Germany .

*Primary Examiner*—Paul A. Bell

*Attorney, Agent, or Firm*—Steele, Gould & Fried

[57] ABSTRACT

An apparatus for closing binding combs to bind stacks of sheet material together possesses a lower working ram having a bending pressing surface formed as a sliding face for perforating prongs of the binding comb, this sliding face being formed by two adjacent, cylindrical rollers, so that the perforating prongs are supported by exclusively rolling on the ram during the closing operation of the binding comb. As a consequence, such a small reaction force is imparted to the perforating prongs against the rolling movement that the binding comb cannot under any circumstances rotate in an undesired manner relative to a counter-ram, so that a squeezing of the binding comb in the region of an arm of the comb opposite the perforating prongs is prevented.

24 Claims, 2 Drawing Sheets

APPARATUS FOR CLOSING BINDING COMBS TO BIND A STACK OF SHEET MATERIAL TOGETHER

FIELD OF THE INVENTION

This invention relates to an apparatus for closing binding combs to bind a stack of sheet material together and in particular to apparatus for closing by bending binding combs having an approximately C-profile as viewed longitudinally and possessing perforating prongs.

BACKGROUND OF THE INVENTION AND DESCRIPTION OF PRIOR ART

In the closing of binding combs using two bending rams, which combs are usually bent from wire, it is very difficult to achieve an accurately pre-determined profile of the closed binding comb, because the relative sliding relationships of the binding comb with respect to the bending rams are of essential importance. These sliding relationships depend not only upon the surface characteristics of the pressing surfaces of the bending rams, but also upon numerous other factors, for example also upon the material characteristics of the surface of the binding comb.

As a rule, a circular profile of the closed binding comb is the intended objective, wherein only the perforating prongs, formed by a C-profile arm, must enter the perforations of the block to be bound during the closing action with a corresponding change in position relative to the working ram associated with them, pass through this block and, finally, penetrate into gaps of the comb of the opposite C-profile arm. The reaction forces that hereby occur between the binding comb and one bending ram must be accepted for the greater part by the engagement between the other bending ram and the associated C-profile arm, it being possible for these reaction forces, acting in the circumferential direction of the binding comb as torsional forces, easily to result in a rotating displacement of the C-profile arm opposite to the perforating prongs relative to the associated bending ram. This displacement, however, leads to a squeezing of this C-profile arm towards the end of the closing bending operation and therefore to an out-of-true shape of the finished, closed binding comb which cannot be calculated. To enable the friction relationships between the binding comb and the two bending rams, which here play an important part, to be adjusted as favourably as possible, it has hitherto usually been attempted to make the sliding face of the working ram as smooth as possible by polishing and to provide the bending face of the opposite bending ram with the highest possible friction co-efficient (DE-PS No. 23 25 867).

It has also already been attempted (DE-PS No. 16 11 018 and DE-PS No. 24 03 154), to obtain an improvement in that the bending rams execute a curved movement differing from a linear movement, but this results in an extremely complicated mechanism of the apparatus, which furthermore is not very suitable for refitting to adapt to binding combs of different profiles.

OBJECT OF THE INVENTION

An object of the present invention is to provide an apparatus, which shall make it possible at any time to close binding combs in such a manner that they always adopt the same, pre-determined profile, such as a circular profile, and that their change in position relative to the bending rams during the bending operation can always be accurately calculated.

SUMMARY OF THE INVENTION

According to the present invention, there is provided an apparatus for closing binding combs by bending them to bind stacks of sheets or the like together, the binding combs having an approximately C-profile as viewed longitudinally and possessing perforating prongs, the apparatus comprising a bending tool which is equipped with first and second bending rams situated opposite each other and movable relatively towards each other, said first ram possessing a pressing surface having a face for the sliding engagement of an associated arm of the binding comb as the curvature by bending takes place, and at least one part of said face being constituted by at least one roller.

Although it is conceivable for the bending pressing surface or sliding face of the working ram to be formed at least partly of a surface that is stationary relative to the working ram, that is by a low-friction surface or the like, and thereby to support the associated C-profile arm at its outer periphery adjacent to the rollers against such a surface in addition, it has been found that the effects can be still further substantially improved by the sliding face of the working ram being constituted exclusively of rollers, so that no sliding contact at all between the binding comb and the working ram takes place.

One especially advantageous embodiment consists in that the associated C-profile arm bears against the working ram in cross-section in the manner of a prism-bearing at two positions lying near to one another in the circumferential direction and/or on either side adjacent to the apex of the curve of the outer circumference of this C-arm and therefore is not subjected to any bending forces which could deform it during the closure operation in an indeterminate manner or change its cross-sectional form.

It is furthermore conceivable to associate a separate roller with each perforating prong or indeed with each of the two arms of each perforating prong or with groups of at least three such arms or two or more perforating prongs, it being permissible then for the axes of these rollers to deviate at least slightly from the position parallel to one another or to the longitudinal axis of the binding comb, in order to influence the movements of the C-profile arms during the closing operation. One construction having high functional reliability is, however, obtained if the roller is provided in the form of one continuous component extending without interruption throughout the length of the sliding face of the working ram and thus of the binding comb to be closed, which (roller) is advantageously provided in the manner of a bending roller, bearing exclusively against the outer face of the curve of the C-profile arm to be bent and is rotatably journalled about an axis accurately parallel to the longitudinal axis of the binding comb.

To provide the most reliable support possible for the C-profile arm which forms the perforating prongs at at least two outermost positions on either side in cross-section, these two positions lie with advantage symmetrically on either side of the axial plane of this C-profile arm and of the binding comb which is parallel to the linear working movement of the bending ram, the angle of arc which determines the distance between these two positions, referred to the axis of curvature of the associated C-arm, being an acute angle advantageously of at least 30° and at most 90°, especially of about 40°. In the latter case, in spite of a relatively large external diameter of the two rollers, the arrangement may be such that the working ram in its cross-section does not occupy a greater width than the opposite bending ram. It is, however, also conceivable, in order to increase the spacing angle of arc between the support positions of the associated C-profile on the working ram, to construct the latter in cross-section wider than the opposite bending ram or its bending pressing surface, a corresponding recess being then optionally formed in a seating for the block or the like to be bound, to permit engagement of the roller situated at the associated side towards the end of the closure movement, so that the closure movement, although this seating lies directly adjacent to the perforations, is not impeded by this seating.

By the provision of at least one stop or entraining device for that end of the arm which lies in the region of the counter-ram situated opposite the working ram, it is indeed possible with the present construction to rotate the binding comb, especially immediately before the end of the closure operation, in a direction about its longitudinal axis relative to the bending rams, which is opposite to that direction in which the reaction forces actually act upon the associated arm due to the engagement into the working ram. The profile arm associated with the counter-ram can, in other words, be rotated slightly towards the end of the closure operation in that direction relative to the counter-ram in which the arm which forms the perforating prongs is bent during the bending operation, so that in spite of a favourable starting position of the C-profile arm which remains outside the perforations during the first phase of the closure operation, this profile arm is prevented from pressing into the associated side of the block to be bound adjacent to the perforations at the end of the closure operation. This stop is movable relative to the counter-ram, especially in the direction of the working movement of the bending tool, which can be achieved in a simple manner by this stop being arranged to be movable in the same direction as the seating for the block to be bound.

BRIEF DESCRIPTION OF THE DRAWINGS

For a better understanding of the invention and to show how the same may be carried into effect, reference will now be made, by way of example, to the accompanying drawings, in which.

DESCRIPTION OF THE PREFERRED EMBODIMENT

Figure 1:
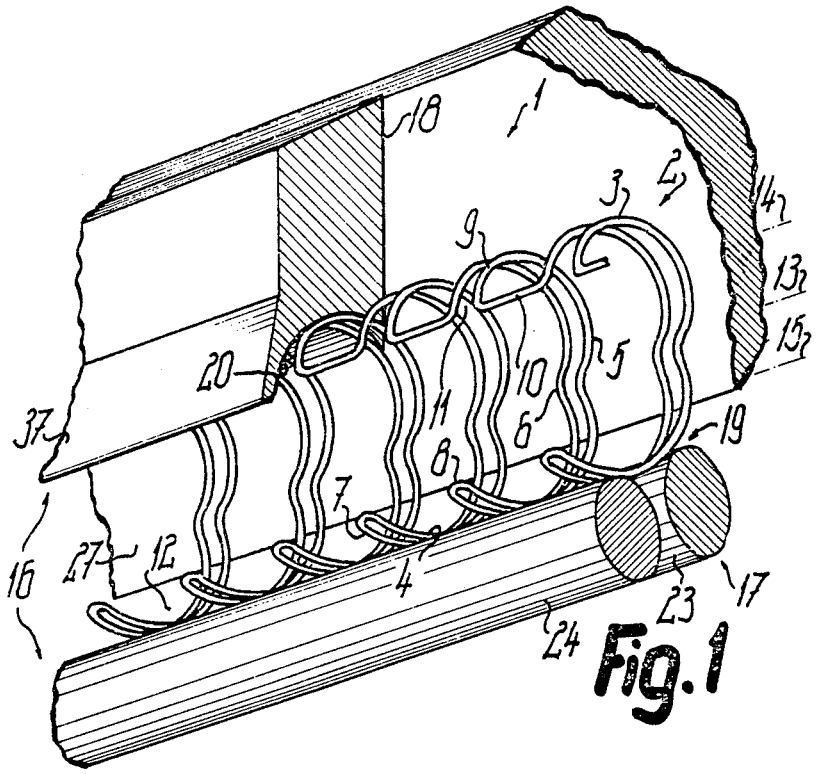
FIG. 1 is a schematic perspective view of an apparatus for closing binding combs to bind a stack of sheet material together, the apparatus being shown in its opened condition.
Figure 2:
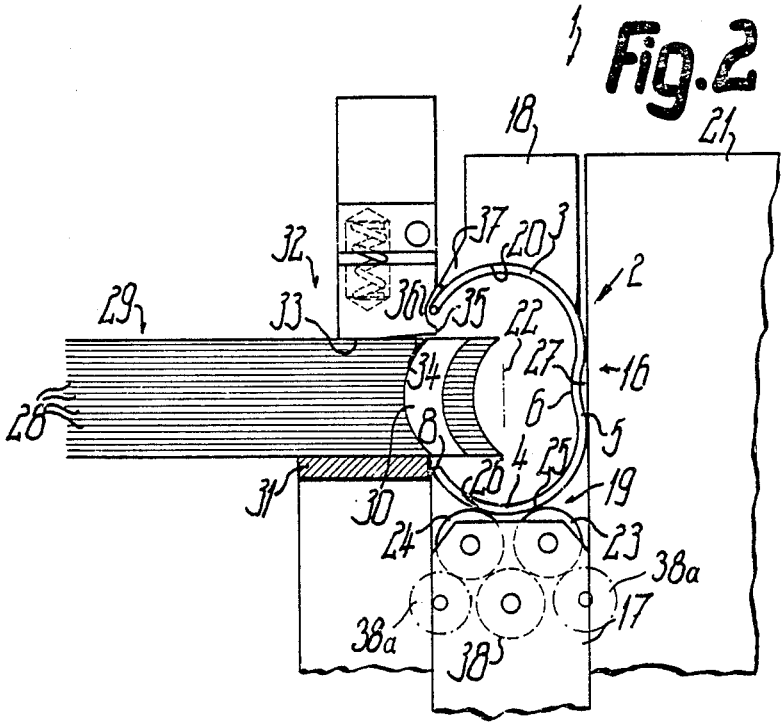
FIG. 2 is a longitudinal view of the closure apparatus of FIG. 1.

The binding comb closure apparatus 1 shown in the drawings serves for the closing of a binding comb blank or a binding comb 2, prefabricated from wire, especially coated, such as lacquered round wire, which has the shape and cross-sectional shape respectively shown in FIGS. 1 and 2. This cross-sectional shape corresponds approximately to a C-profile or to that of the numeral "3", the wire forming in longitudinal direction of the binding comb 2 a number of successive sections of this form, which each lie in a plane perpendicular to a longitudinal central axis 13 of the binding comb 2 and are connected alternately with one another at the one end of an arm and at the other end of an arm of this form by portions lying generally longitudinally of the binding comb 2. The portions corresponding to the profile form are located, in the longitudinal direction of the binding comb 2, alternately at smaller but equal and at larger but also equal spacings from one another.

Figure 3:
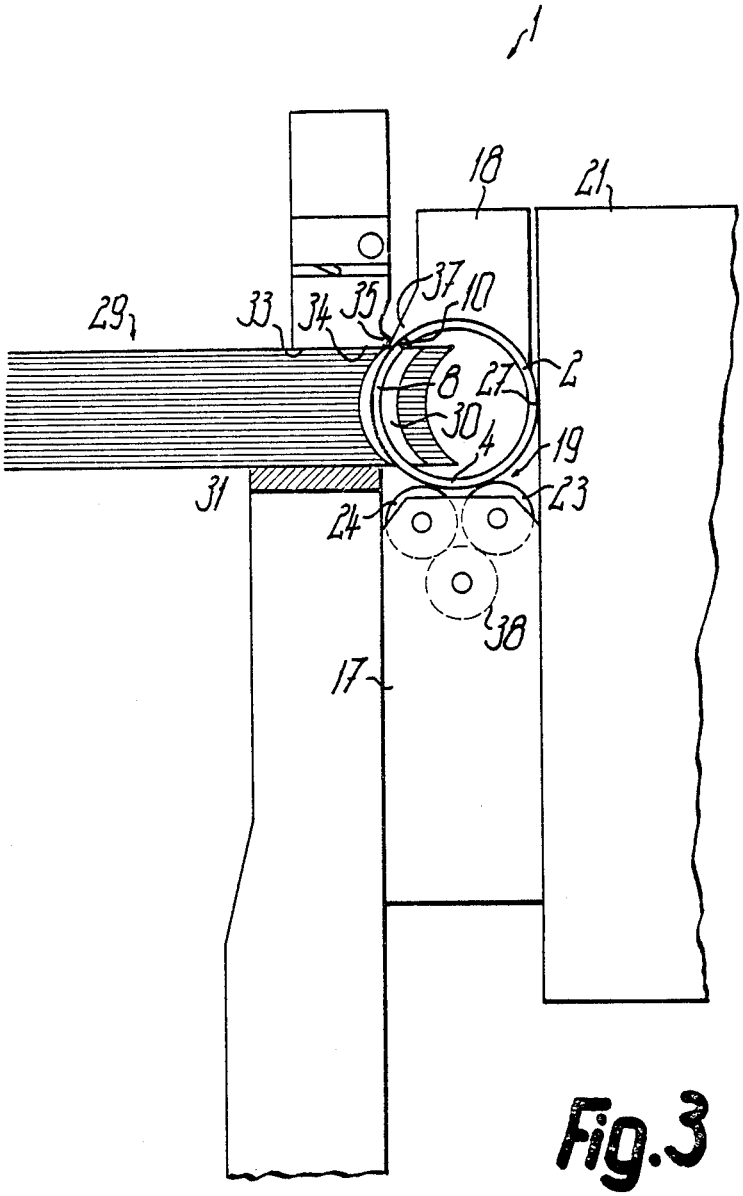
FIG. 3 is a view similar to that shown in FIG. 2 but showing the apparatus in its closed condition.

The binding comb 2 forms, by the aforementioned cross-sectional shape, two approximately semi-circular, curved, mutually opposed arms 3, 4 having the same radius of curvature, which is approximately equal to the radius of the finished, closed binding 2 shown in FIG. 3, so that these arms 3, 4 are themselves not bent during the closure operation. The arms 3, 4 are connected together by transverse ribs 5, which are each furnished with a hinge kink 6, forming a projection towards the longitudinal central axis of the binding comb 2 at the centre between the arms 3, 4, at which hinge kink 6 the binding comb 2 is deformed in the principal axis during closure until this hinge kink 6 has been converted into a continuation of the circular form of the arms 3, 4.

Each two more closely spaced wire portions, having the profile form of the binding comb 2, constitute in the region of one arm 4 a perforating prong 7 and lead continuously one into the other at the end of this arm 4 via an approximately semi-circular, curved arm end 8. The other arm 3 constitutes, with two more widely spaced portions corresponding to the profile form of the binding comb 2, a correspondingly wider counter-prong 9, of which the two portions, corresponding to the profile form of the binding comb 2, are integrally connected together at the end of the associated arm 3 by an arm end 10, formed integrally with them and generally parallel to the longitudinal central axis 13. Between adjacent counter-prongs 9, prong gaps 11 are thus formed, the width of which corresponds to the width of the perforating prongs 7, lying opposite to and aligned with them, between which prongs in turn wider prong gaps 12 for engagement of the counter-prongs 9, aligned with them and of approximately the same width, are formed.

In the closed condition, the binding comb 2 extends between the arm ends 8, 10 through an angle of more than 360°, so that the perforating prongs 7 engage into the prong gaps 11 and the perforating prongs 7 and counter-prongs 9, meshing into one another like a comb, lie in register as viewed longitudinally. The axes of curvature 14, 15 of the two arms 3, 4 which, when the binding comb 2 is open, lie on either side of its longitudinal central axis 13, therefore coincide with this longitudinal central axis 13 after closure.

For closure, the closure apparatus 1 comprises a bending tool 16, having two bending rams, opposite each other, in the form of a lower ram 17 and a counter-ram 18 above and opposite it, of which the counter-ram 18 is mounted fixed on a bracket 21 of the closure apparatus 1, while the ram 17 is movable to and fro in a linear, vertical bending stroke by a suitable drive, that is to say can be moved onto the counter-ram 18 during the closure operation. The ram 17 possesses, as a bending pressing surface, a sliding face 19 for the associated arms 4 of the binding comb 2, while the counter-ram 18 has, as a bending pressing surface 20, a concave, curved counter-surface accurately adapted to the contour of the outer periphery of the associated arms 3, which (counter-surface) extends through an angle of arc of considerably more than 90°, preferably about 110°, referred to the axis of curvature 14 of this arm 3, and therefore through an angle of arc which is considerably greater, for example approximately three times greater, than the corresponding angle of the sliding face 19. From the axial plane 22, passing through the longitudinal central axis 13 of the binding comb 2 and through the axis of curvature of the bending pressing surface 20 and orientated parallel to the direction of movement of the ram 17, the bending pressing surface 20 extends towards its side associated with the transverse rib 5 through a greater angle than at the opposite side, this larger angle being about one-half larger than the smaller angle, which advantageously is about 45°.

The sliding face 19 is formed by the continuous, cylindrical circumferential surfaces of two cylindrical rollers 23, 24, with parallel axes, which are perpendicular to the direction of movement and parallel to the longitudinal central axis of the binding comb 2, which rollers bear against each wire portion of the arm 4 only at two positions 25, 26 in punctiform manner due to the circular profile of the binding comb 2, these positions being located at the outer periphery of the arm 4, which is not directly supported or guided on the inside. The two positions 25, 26 lie symmetrically on either side of the axial plane 22 and, in relation to the axis of curvature 15 of the arm 4, at an angle of arc to each other which is consideably smaller than 70°, preferably about 40°. The external diameter of the circumferential surfaces of the rollers 23, 24 is considerably smaller than the external diameter of the arm 4 or of the finished, closed binding comb 2, preferably only about half as large. The two rollers 23, 24 can thereby be so arranged immediately adjacent to each other with a small gap between, and perpendicularly to the axial plane 22, that their outer faces, remote from each other, extend only about to the boundary planes of the counter-ram 18, parallel to the axial plane 22, or are slightly set back from the boundary plane of the counter-ram 18 associated with the transverse rib 5, while the other roller 24 projects slightly outwards with respect to the opposite, outer boundary plane of the counter-ram 18 and of the bending pressing surface 20, but is set back from the associated boundary plane of the ram 17 by a small gap distance.

For the outer side of the transverse rib 5 or the hinge kink 6 of the binding comb 2, the closure apparatus 1 possesses a pressure support 27 in the form of a flat abutment surface parallel to the axial plane 22, which surface may be formed by the side of the bracket 21 which carries the counter-ram 18 and guides the ram 17 and, when the binding comb 2 is still open as in FIG. 2, bears in punctiform manner against the associated tops of the curves of the arms 3, 4 on either side of the hinge kink 6, whereas, towards the end of the closure operation, it bears in punctiform manner only against one position of the transverse rib 5, namely at that position which previously formed the hinge kink 6 and has been deformed into an opposite curvature, continuous with the arms 3, 4, during the closure operation.

A block 29 which is to be bound by the binding comb 2, consists of layers of sheets 28 and possesses edge perforations 30 for binding. For the block 29, the closure apparatus 1 has a seating 31 perpendicular to the axial plane 22, this seating being mounted movable in the direction of movement of the bending tool and ram 17. This seating 31, in its starting position and in the starting position of the ram 17, is at a distance from the axial plane of the binding comb 2 perpendicular to the axial plane 22 which is only slightly smaller than the corresponding distance of the end 8 of the arm of the binding comb 2 from this axial plane. At the start of the stroke movement of the ram 17, the seating 31 is entrained in the stroke direction by substantially the same amount, until it has reached a limit position shown in FIG. 3 by running up against a stop, in which its distance from the axial plane of the axis of curvature 14 of the arm 3 parallel to it is approximately equal to one-half of the thickness of the block 29. The arrangement is such that, when this limit position of the seating 31 is reached, the upper face of the block 29 has approximately reached the lower face of the counter-ram 18 or associated outer boundary of the bending pressing surface 20. The ram 17 is then moved a small distance further in its direction of stroke, until the binding comb 2 is completely closed and circular. During the stroke of the ram 17, the perforating prongs 7 penetrate from below, with a rolling movement on the rollers 23, 24, that is in a circular movement corresponding to their circular arc form, into the perforations 30, while the arms 3 remain fixed in their position relative to the counter-ram 18.

As FIGS. 2 and 3 also show, the seating 31 constitutes a reaction member which forms, together with a clamping jaw 32 above and opposite it, a clamping and holding device for the block 29, the clamping jaw 32 possessing a clamping surface 33 opposite the seating 31 and parallel to it, which leads into a free surface 34 ascending at an acute angle to the bending rams in such a manner that this free surface 34 is at an acute angle of a few degrees, open towards the bending rams, to the associated side of the block 29. This free surface 34 forms one flank face of a stop 35, provided on the clamping jaw 32 and extending in the manner of a rib longitudinally of the closure apparatus, that is parallel to the longitudinal central axis 13.

A stop surface of the stop 35 faces towards the counter-ram 18 and lies at an angle of less than 90° and preferably more than 45°, open towards the bending pressing surface 20, to the axial plane 22. The stop surface forms the flank face, remote from the free surface 34, of the stop 35, the longitudinal edge of which is rounded in cross-section. The stop surface continues, at its longitudinal side remote from the longitudinal edge of the stop 35, into the base surface of an engagement surface 36 for the arm end 10 of the binding comb 2, which engagement surface 36 is formed by a depression of substantially concave section at the associated face of the clamping jaw 32 towards the counter-ram 18. The engagement surface 36 forms a guide surface for the arm end 10, at which the arm end 10 can be guided, if necessary until it reaches the stop 35.

The bending pressing surface 20 of the counter-ram 18 is bounded, at its side towards the stop 35 or engagement surface 36 and therefore towards the clamping jaw 32, by a nose 37 projecting in cross-section beyond the remainder of the face of the counter-ram 18, the flank surface of this nose remote from the bending pressing surface 20 and opposite the clamping jaw 32 being inclined towards the rear. The longitudinal edge of the nose 37 lies approximately in the same plane, parallel to the axial plane 22, as the longitudinal edge of the stop 35, or is separated from it only by the necessary movement clearance.

The clamping jaw 32 and stop 35 move, during the stroke of the seating 31, together with this seating out of the starting position into the position shown in FIG. 3, in which the stop 35 has just moved past the nose 37. During the movement of the stop 35 relative to the nose 37 and counter-ram 18, the stop 35 strikes against the end 10 of the arm projecting in the starting position slightly beyond the nose 37 and entrains this end, rotating the arm 3 and the entire binding comb 2, already substantially circular, relative to the bending pressing surface 20, until the arm end 10 has displaced into the bending pressing surface 20 generally in the region of the end of the nose 37. In the starting position, the arm end 10 lies in the engagement surface 36. The stroke movement of the seating 31 and of the clamping jaw 32 movable with it and of the stop 35 is infinitely adjustable by means of adjustable stops, such as abutment screws.

When the binding comb 2 is completely closed as shown in FIG. 3, the ram 17 executes, with the seating 31, a return stroke, after which the finished bound block 29 can be removed from the press.

As FIG. 2 also shows, the rollers 23, 24 may be supported against the applied pressure between their ends at at least one longitudinal section by at least one support member 38, against which the rollers 23, 24 bear on their sides remote from the face 19. For each roller 23, 24, a separate support member may be provided or both the rollers 23, 24 may be supported on one common support member 38. The support member 38 may advantageously be formed by a support roller, which is rotatable about an axis parallel to the rollers 23, 24. The rollers 23, 24 are journalled at their ends in cheek plates 39 of the ram 17.

To provide an especially uniform support for the rollers 23, 24, three support rolls may be provided, for example additionally the lateral support rollers **38*a* shown in dot-and-dash line in FIG. 2, which run in corresponding recesses of the components 21, 31**.

Prior to the present invention, it had been assumed that, in order to achieve an accurate profile of the closed binding comb, it was necessary for both the bending pressing surfaces of the bending rams to be adapted in their cross-section as accurately as possible to the external form of the C-profile arms of the binding comb and to support the latter continuously over the largest possible angle of arc, in order to ensure maintenance of the profile of these already pre-bent C-arms during the entire bending operation. In contrast it will be appreciated that, with the present apparatus, because the C-profile arm which forms the perforating prong is supported at its external periphery by the working ram only at a few positions in its cross-section, especially at most along lines or even only at points, the result is achieved in a surprisingly simple manner that, on the one hand, an extremely easy running of this C-profile arm on the working ram is obtained and, on the other hand, this C-profile arm can be so supported during the bend ing operation that deformations of this C-shaped arm during bending, which could lead to out-of-true shape of the closed comb, are prevented. By the easy running relative to the working ram, such very small reaction forces result that the uncalculatable rotation of the other C-profile arm relative to the associated bending ram can be completely prevented.

I claim:

1. An apparatus for closing binding combs by bending them to bind stacks of layers together, the respective binding comb (2) having an approximately C-profile as viewed longitudinally and possessing prongs (7), formed by profile arms and adapted to engage perforations (30), the apparatus comprising:

a binding tool (16), having first and second bending rams (17, 18) located opposite each other and being movable relatively towards each other;

said first ram (17) having a pressing surface with a bearing face (19) for movable engagement of an associated one of said profile arms (4) of the binding comb (2) as the curvature by bending takes place, wherein at least a part of said bearing face (19) is constituted by at least one roller means.

2. An apparatus according to claim 1, wherein said bearing face engages the associated profile arm without any friction contact.

3. An apparatus according to claim 1, wherein the said entire bearing face of said first ram is constituted by said at least one roller means, having at least one circumferential face.

4. An apparatus according to claim 1, wherein said roller means comprises two rollers (23, 24) lying adjacent to one another in a direction transversely to a longitudinal extent of said bearing face.

5. An apparatus according to claim 4, wherein the circumferential faces of said rollers are located directly adjacent to each other, a small gap-like spacing being provided between said circumferential faces.

6. An apparatus according to claim 4, wherein said two rollers are identical to one another.

7. An apparatus according to claim 1, wherein each roller means has a circumferential face of circular cross-section.

8. An apparatus according to claim 7, wherein said circumferential face is cylindrical throughout a longitudinal extension of said roller means.

9. An apparatus according to claim 1, wherein each roller means has ends, means being provided to support the respective each said roller between its ends at least at one location against bending pressure.

10. An apparatus according to claim 1, wherein at least one of said roller means is uninterruptedly extending over an entire longitudinal extension of said bearing face.

11. An apparatus according to claim 1, wherein means are provided to rotatably journal said roller means about at least one axis parallel to the longitudinal extension of said bearing face.

12. An apparatus according to claim 1, wherein the roller means are mounted between side check members provided on said first ram.

13. An apparatus according to claim 1, wherein the roller means has a diameter substantially smaller than a diameter of a curvature of the associated profile arm of the binding comb as being bent by the apparatus.

14. An apparatus according to claim 13, wherein the diameter of said roller means is equal to at most half of the diameter of said curvature.

15. An apparatus according to claim 1, wherein said first ram has an entire width, the roller means extending substantially over said entire width of said first ram.

16. An apparatus according to claim 4, wherein sides of said two rollers remote from each other are at a distance from associates outer faces of said first ram substantially equal to the gap-like spacing between said two rollers.

17. An apparatus according to claim 1, wherein said first ram is located beneath said second ram.

18. An apparatus according to claim 1, comprising a seating for a block of layers of sheets to be bound and wherein said first ram is mounted to be commonly movable over a portion of a working stroke with said seating.

19. An apparatus according to claim 1, wherein on a side of the apparatus associated with an open side of the profile of the binding comb, a stop is provided adjacent to said second ram to stop movement of an end of the associated profile arm of the binding comb during binding.

20. An apparatus according to claim 19, wherein said stop is formed by a rib-shaped projection bounding an engagement surface of concave cross-section in which said end of the associated profile engages.

21. An apparatus according to claim 19, wherein said stop is mounted so as to be commonly movable with said first ram at least over a portion of the working stroke of the latter.

22. An apparatus according to claim 19, wherein said stop is formed by a clamping jaw to clamp the layers of sheets against the seating.

23. An apparatus according to claim 19, wherein said second ram has a projection nose located opposite said stop, said projection nose being bounded by flanks, one of said flanks being formed by a pressing surface of the second ram.

24. An apparatus according to claim 23, wherein said stop is arranged for moving past said projection nose substantially without clearance.

* * * * *